US010845036B2

(12) United States Patent
Shao et al.

(10) Patent No.: US 10,845,036 B2
(45) Date of Patent: Nov. 24, 2020

(54) DUAL-COLOR LIGHT STRINGS

(71) Applicant: BLOOMING INTERNATIONAL LIMITED, British West Indies (AI)

(72) Inventors: Shu-Fa Shao, Taipei (TW); Johnny Chen, Taipei (TW)

(73) Assignee: Blooming International Limited, British West Indies (AI)

( * ) Notice: Subject to any disclaimer, the term of this patent is extended or adjusted under 35 U.S.C. 154(b) by 0 days.

(21) Appl. No.: 16/547,377

(22) Filed: Aug. 21, 2019

(65) Prior Publication Data

US 2019/0376669 A1 Dec. 12, 2019

Related U.S. Application Data

(63) Continuation-in-part of application No. 16/298,935, filed on Mar. 11, 2019.
(Continued)

(51) Int. Cl.
*F21V 19/00* (2006.01)
*F21V 23/00* (2015.01)
(Continued)

(52) U.S. Cl.
CPC ..... *F21V 19/0025* (2013.01); *A41G 1/007* (2013.01); *F21V 19/002* (2013.01);
(Continued)

(58) Field of Classification Search
None
See application file for complete search history.

(56) References Cited

U.S. PATENT DOCUMENTS 4,675,575 A 6/1987 Smith et al.
4,761,720 A 8/1988 Solow
(Continued)

FOREIGN PATENT DOCUMENTS

CA 2 655 486 A1 9/2009
CN 200982547 Y 11/2007
(Continued)

OTHER PUBLICATIONS

U.S. Appl. No. 16/219,657, filed Dec. 13, 2018, Inventor Johnny Chen (155 pages).
(Continued)

*Primary Examiner* — Britt D Hanley
(74) *Attorney, Agent, or Firm* — Christensen, Fonder, Dardi & Herbert PLLC

(57) ABSTRACT

A dual-color light string comprising a first insulated electrical wire cord, a second insulated electrical wire, two light-emitting diode devices (LED devices) and transparent glue. The first insulated electrical wire is partially exposed to form a first soldering section. The second insulated electrical wire is partially exposed to form a second soldering section. The two LED devices are respectively electrically connected to the first soldering section and the second soldering section, and the directions of bias of the two LED devices from the first soldering section to the second soldering section are opposite to each other; The transparent glue covers the two LED devices, the first soldering section and the soldering section, extends to partially cover a first insulating layer of the first insulated electrical wire and a second insulating layer of the second insulated electrical wire.

20 Claims, 11 Drawing Sheets

Related U.S. Application Data

(60) Provisional application No. 62/728,498, filed on Sep. 7, 2018, provisional application No. 62/682,683, filed on Jun. 8, 2018.

(51) Int. Cl.
*A41G 1/00* (2006.01)
*F21Y 113/17* (2016.01)
*F21Y 115/10* (2016.01)

(52) U.S. Cl.
CPC ..... *F21V 23/001* (2013.01); *F21Y 2113/17* (2016.08); *F21Y 2115/10* (2016.08)

(56) References Cited

U.S. PATENT DOCUMENTS 4,812,956 A 3/1989 Chen
5,109,324 A 4/1992 Ahroni
5,150,964 A 9/1992 Tsui
5,747,940 A 5/1998 Openiano
5,834,901 A 11/1998 Shen
6,091,204 A * 7/2000 Chen ..... H05B 39/09 315/185 R
6,367,952 B1 4/2002 Gibboney, Jr.
6,582,094 B2 6/2003 Liu
6,592,238 B2 7/2003 Cleaver et al.
6,604,841 B2 8/2003 Liu
6,609,814 B2 8/2003 Ahroni
6,777,891 B2 8/2004 Lys et al.
6,914,194 B2 7/2005 Fan
7,088,904 B2 8/2006 Ryan, Jr.
7,131,748 B2 11/2006 Kazar et al.
7,186,005 B2 3/2007 Hulse
7,235,815 B2 6/2007 Wang
7,253,566 B2 8/2007 Lys et al.
7,926,978 B2 4/2011 Tsai
8,076,872 B2 12/2011 Sauerlander
8,397,381 B2 3/2013 Tsai
8,568,015 B2 10/2013 Chen
8,608,342 B2 12/2013 Chen
8,641,229 B2 2/2014 Li
8,680,773 B2 3/2014 Hering et al.
9,060,409 B2 * 6/2015 Bowers ..... H05B 33/0863
9,279,551 B2 3/2016 Vissenberg et al.
9,291,318 B1 3/2016 Benson
9,655,211 B2 5/2017 Altamura et al.
9,788,384 B1 10/2017 Harris
9,907,136 B2 2/2018 Leung et al.
9,939,117 B1 4/2018 Peng
10,006,596 B2 6/2018 Yu et al.
10,123,387 B2 11/2018 Lai
10,136,497 B2 11/2018 Harris
10,178,887 B1 * 1/2019 Chen ..... A41G 1/005
10,184,654 B1 1/2019 Chen
10,205,073 B2 2/2019 Altamura
10,288,235 B1 * 5/2019 Chen ..... H01L 27/153
10,288,236 B1 5/2019 Chen
10,578,260 B1 3/2020 Chen
2002/0027778 A1 3/2002 Ko
2003/0063463 A1 4/2003 Sloan et al.
2006/0221609 A1 10/2006 Ryan, Jr.
2007/0015396 A1 1/2007 Mrakovich et al.
2008/0084702 A1 4/2008 Cheung
2008/0094828 A1 4/2008 Shao
2009/0154156 A1 * 6/2009 Lo ..... F21V 5/00 362/234
2009/0302771 A1 12/2009 Peng
2010/0001664 A1 1/2010 Shih
2010/0141161 A1 6/2010 Hering et al.
2010/0157598 A1 6/2010 Tsai
2010/0277084 A1 11/2010 Lee
2011/0062875 A1 3/2011 Altamura
2011/0210677 A1 9/2011 Hering et al.
2011/0228535 A1 * 9/2011 Shao ..... H05B 33/06 362/249.02
2011/0310601 A1 * 12/2011 Shao ..... F21V 23/00 362/231
2012/0039070 A1 2/2012 Shen et al.
2012/0075863 A1 3/2012 Chen
2012/0275157 A1 11/2012 Hsu
2013/0078847 A1 3/2013 Chen
2013/0107514 A1 5/2013 McNabb et al.
2013/0301246 A1 * 11/2013 Chen ..... A41G 1/005 362/123
2015/0008835 A1 1/2015 Sugiura et al.
2016/0183338 A1 6/2016 Loomis
2016/0186940 A1 6/2016 Del Castillo et al.
2016/0341408 A1 11/2016 Altamura
2017/0023223 A1 1/2017 Tsai
2017/0038055 A1 2/2017 Daniels
2017/0295622 A1 10/2017 Harris
2017/0343170 A1 11/2017 Yu et al.
2018/0020519 A1 1/2018 Harris
2018/0020520 A1 1/2018 Harris
2018/0172225 A1 6/2018 Zhao
2018/0172226 A1 * 6/2018 Zhao ..... H05B 33/0845
2018/0299084 A1 10/2018 Chien
2019/0053348 A1 2/2019 Harris
2019/0078767 A1 * 3/2019 Loomis ..... F21V 23/002
2019/0234597 A1 * 8/2019 Zhu ..... F21V 23/023
2019/0277458 A1 9/2019 Shao

FOREIGN PATENT DOCUMENTS

CN 201121811 Y 9/2008
CN 201897194 U 7/2011
CN 201898147 U 7/2011
CN 201966240 U 9/2011
CN 202613183 U 12/2012
CN 203703878 U * 7/2014
GB 2 454 546 A 5/2009

OTHER PUBLICATIONS

U.S. Appl. No. 16/298,935, filed Mar. 11, 2019, Inventor Shu Fa Shao (81 pages).

* cited by examiner

DUAL-COLOR LIGHT STRINGS

PRIORITY CLAIM

The present application is a continuation-in-part of U.S. patent application Ser. No. 16/298,935, filed Mar. 11, 2019, which claims the benefit of U.S. Provisional Application No. 62/682,683, filed Jun. 8, 2018, and also claims priority to Chinese Patent Application No. 201810195592.5, filed Mar. 9, 2018, the present application also claims the benefit of U.S. Provisional Application No. 62/728,498, filed Sep. 7, 2018, and also claims priority to Chinese Patent Application No. 201810962061.4, filed Aug. 22, 2018, all of which are incorporated herein by reference in their entireties.

FIELD OF THE INVENTION

The instant disclosure relates to decorative lighting, and in particular, to dual-color light strings.

BACKGROUND

A light string includes plural light sources directly soldered onto an electric cord at intervals, so as to form a string-shaped illumination device without traditional lamp holders as known in the art. The use and arrangement of small-sized light sources that include light-emitting diodes (LEDs) to form a light string is known.

In the art, light sources are soldered to a copper core after the insulating layer of the electric cord is removed, and then an electric-insulating treatment is performed on the solder joints. With this approach, light sources obviously stick out on the electric cord and typically are configured to have high-directivity. When a user arranges known light strings, which may include pulling on the light string, solder joints holding the light sources to the electric cord may crack or otherwise be compromised. Furthermore, as such, when an electric cord of the light string is pulled or bent, stress concentration often occurs at the solder joints, resulting in cracked solder joints.

Further, when dual-color lighting is desired, two light strings having different colors are often stranded or wound together. However, if two light strings are wound together, the problem of cracked solder joints is exacerbated.

SUMMARY

Accordingly, the instant disclosure provides a dual-color light string to solve the above-mentioned problems.

A dual-color light string according to the instant disclosure comprises a first insulated electric wire, a second insulated electrical wire, two light-emitting diode devices (LED devices) and transparent glue. The first insulated electrical wire includes a first conductive core, the first insulating layer covers the first conductive core, and the first conductive core is partially exposed to form a first soldering section. The second insulated electrical wire includes a second conductive core and a second insulating layer, the second insulating layer covers the second conductive core, the second conductive core is partially exposed to form a second soldering section, and the first conductive core and the second conductive core are electrically isolated from each other. The two LED devices are respectively electrically connected to the first soldering section and the second soldering section, and the directions of bias of the two LED devices from the first soldering section to the second soldering section are opposite to each other. Transparent glue covers the two LED devices, the first soldering section and the second soldering section and extends to partially cover the first insulating layer and the second insulating layer.

In one or more embodiments, the dual-color light string further comprises a carrier, the two LED devices are on the carrier, and the electrode connection nodes of the two LED devices are located at two lateral edge of the carrier to connect the first soldering section and the second soldering section.

In one or more embodiments, the two LED devices are combined into a single packaged chip.

In one or more embodiments, the carrier is perpendicular to the first soldering section and the second soldering section.

In one or more embodiments, the carrier includes two notches at the two lateral edges, the electrode connection nodes of the two LED devices connecting the first soldering section and the second soldering section are respectively located in the two notches, and the first soldering section and the second soldering section are respectively embedded into the two notches.

In one or more embodiments, the dual-color light string further comprises two carriers, and the two LED devices are respectively on the two carriers.

In one or more embodiments, the two carriers are perpendicular to the first soldering section and the second soldering section.

In one or more embodiments, the two LED devices are side-emitting LED devices and respectively emit light in a direction in parallel to the first insulated electrical wire and the second insulated electrical wire.

In one or more embodiments, the directions of light emitting of the two LED devices are the same or opposite of each other.

In one or more embodiments, the two carriers are in parallel to the first soldering section and the second soldering section.

The instant disclosure also provides a light string that comprises a first insulated electrical wire including a first conductive core and a first insulating layer; wherein the first insulating layer covers the first conductive core and the first conductive core is partially exposed to form a first soldering section; a second insulated electrical wire including a second conductive core and a second insulating layer; wherein the second insulating layer covers the second conductive core, the second conductive core is partially exposed to form a second soldering section, and the first conductive core and the second conductive core are electrically isolated from each other; an LED device electrically connected to the first soldering section and the second soldering section; wherein the LED device is a side-emitting LED device having a light emitting direction in parallel to the first insulated electrical wire and the second insulated electrical wire; and transparent glue covering the LED device, the first soldering section and the second soldering section and extending to partially cover the first insulating layer and the second insulating layer. In one embodiment, at least two LED devices are respectively soldered onto plural pairs of soldering sections, and the direction of bias of the these LED devices from the first soldering section to the second soldering section are opposite to each other, so as to form a dual-color light string.

In the dual-color light string according to one or more embodiments of the instant disclosure, the LED devices are firmly fixed between the first insulated electrical wire and the second insulated electrical wire to provide dual-color illumination.

BRIEF DESCRIPTION OF THE DRAWINGS

The present invention will become more fully understood from the detailed description given herein below for illustration only, and thus not limitative of the present invention, wherein.

Figure 1A:
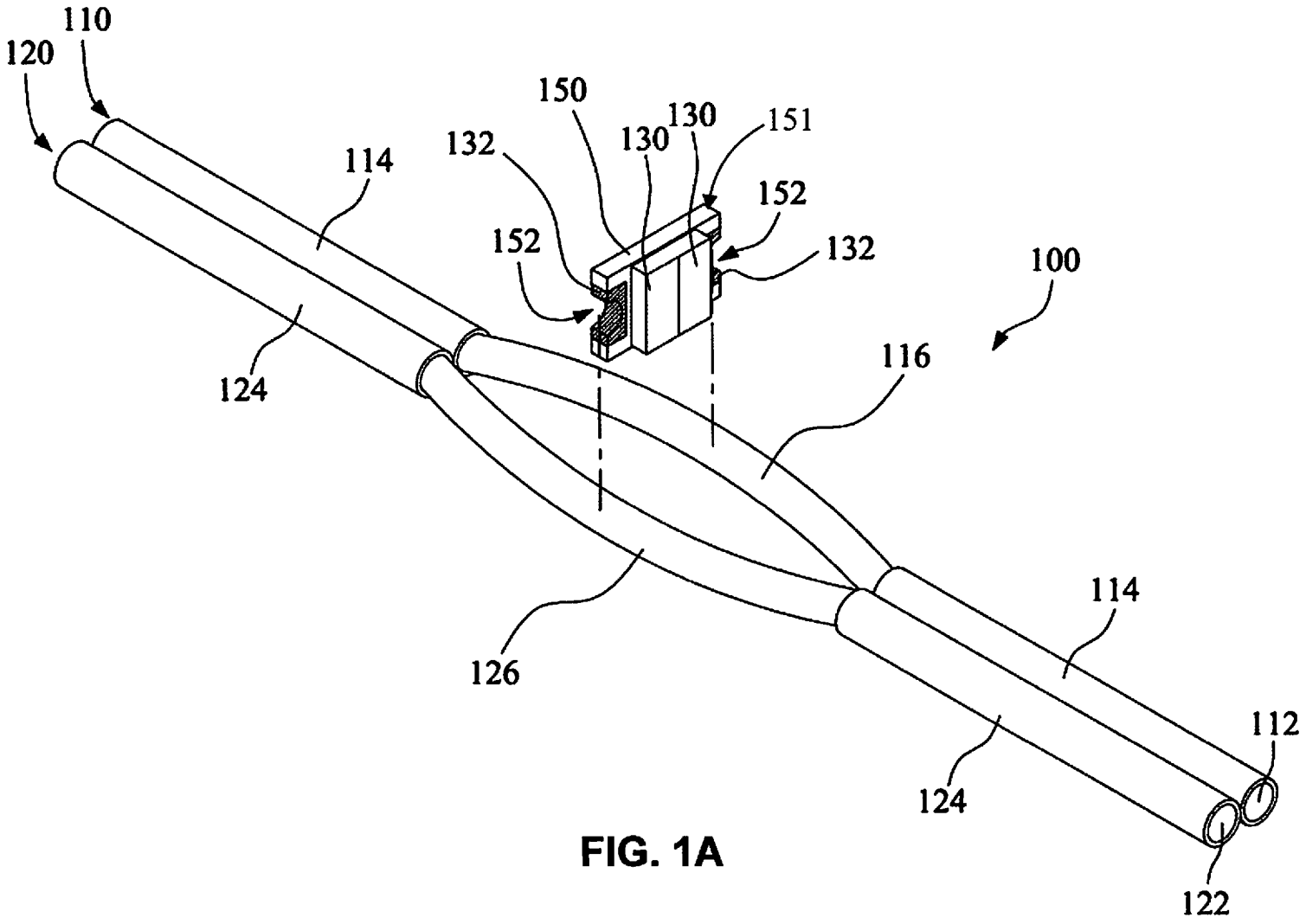
FIG. 1A is an exploded view of a first insulated electrical wire, a second insulated electrical wire and two LED devices according to a first embodiment of the instant disclosure.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Figure 1B:
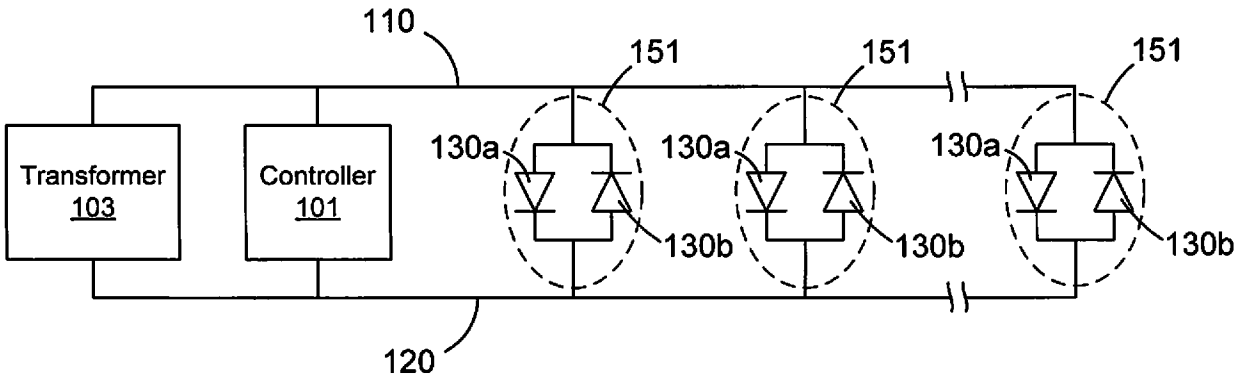
FIG. 1B is a circuit diagram of a light set that includes the embodiment of FIG. 1A.
Figure 2:
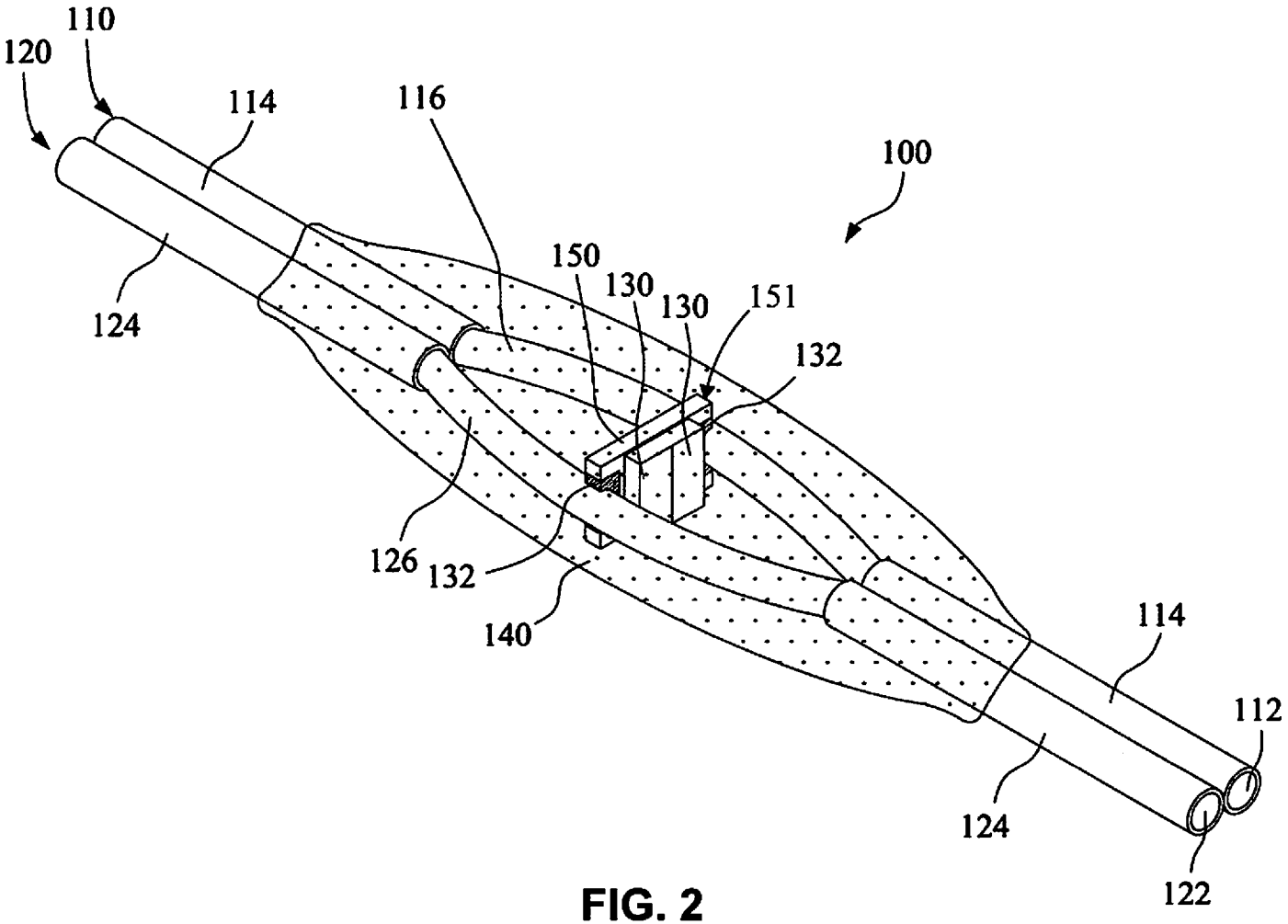
FIG. 2 is a three dimensional view of the first insulated electrical wire, the second insulated electrical wire and the two LED devices combined together according to the first embodiment of the instant disclosure.

Referring to FIGS. 1A, 1B and 2, a dual-color light string 100 according to a first embodiment comprises a first insulated electrical wire 110, a second insulated electrical wire 120, an LED assembly 151, and a transparent covering, such as an adhesive or glue, "transparent glue" 140. In an embodiment, dual-color light string 100 may also include a power plug (not depicted) for connecting light string 100 to an external power supply, and/or a power receptacle (not depicted), for connecting light string 100 to a power plug of another light string, such as a light string 100.

In an embodiment, dual-color light string 100 may include a controller 101 for selectively controlling power transmitted to LED assemblies 151.

In an embodiment, dual-color light string 100 may include a transformer or power converting circuitry 103 for converting an incoming alternating-current (AC) power to a direct-current (DC) power.

In an embodiment, LED assembly 151 includes a carrier 150, and two LED devices 130 on carrier 150, the two LED devices 130 comprising a "set" of LED devices 130. Two LED devices 130 may include a first LED device 130 labeled as 130*a*, and may include a second LED device 130 labeled as 130*b*.

Although FIGS. 1A and 2 depict only one LED assembly 151 with two LED devices 130 as a set, it will be understood that the dual-color light string 100 according to the instant disclosure may equipped with a plurality of LED assemblies 151 with sets of LED devices 130. These LED device 130 sets are continuously arranged on the first insulated electrical wire 110 and the second insulated electrical wire 120, and are electrically connected to the first insulated electrical wire 110 and the second insulated electrical wire 120 in parallel, or as described further below, LED device 130 sets may be electrically connected to one another in parallel, series, or in a series-parallel arrangement.

Referring specifically to FIG. 1B, an electrical schematic of a plurality of LED assemblies 151 connected in parallel to each other to form a circuit of an embodiment of a light string 100 is depicted. In the depicted embodiment, each LED assembly 151 includes a set of LED devices 130 comprising two LED devices 130. A first LED device 130 (labeled as LED device 130*a*) is electrically connected to a second LED device 130 (labeled as LED device 130*b*) in parallel. In the depicted embodiment, LED devices 130*a* and 130*b* are electrically connected in parallel, but are electrically connected to wires 110 and 120 to be electrically biased opposite one another, as described further below.

In operation, a voltage bias or polarity may be selectively controlled by controller 101 of light string 100 or by another control device so as to positively bias a first LED device 130*a*, while negatively biasing a second LED device 130*b*, such that first LED device 130*a* emits light of a first color while second LED device 130*b* does not emit light, or conversely, negatively bias the first LED device 130*a*, while positively biasing the second LED device 130*b*, such that the second LED device 130*b* emits light of a second color, while the first LED device 130*a* does not emit light.

When a DC voltage is selectively applied to the sets of LED devices 130, as described above, the controller 101 may, based on the input of a user, or based upon instructions stored in a memory device associated with the controller 101, selectively control the power/voltage bias delivered to the LED sets. A first electrical bias configuration may cause the first LED device 130*a* to emit light continuously for a predetermined period of time; a second bias configuration may cause the second LED device 130*b* to emit light continuously for a predetermined period of time. The controller 101 may also selectively alternate the bias to cause the LED devices 130*a* and 130*b* to alternate being powered on and off. For example, the first LED device 130*a* may be on and emit light of a first color for a few minutes (or another predetermined period of time), then turned off, with the second LED device 130*b* being turned on to emit light having a second color. In other words, the light color is changed back and forth by changing the electrical bias to the set of LED devices 130. It will be understood that any number of switching or alternating programs may be used to selectively control LED devices 130 and to create a lighting effect using one or more light colors.

Alternatively, controller 101 may provide an alternating current (AC) power to LED devices 130. When an AC power is applied to the first insulated electrical wire 110 and the second insulated electrical wire 120, the direction of the bias from the first insulated electrical wire 110 to the second insulated electrical wire 120 continuously changes, in every half-period, one of the two LED devices 130 is forward biased to emit light, and the other one is disabled as being reverse biased. By continuously applying the alternating current, the two LED devices having different colors emit light alternatively. At a relatively high frequency, such as 60 Hz, the LED devices alternate very quickly, and in such case, the human eye may perceive a third color that is a combination of the first color and the second color. In other instances, a user may perceive the two colors alternatingly as the bias is alternated.

As shown in FIG. 1A and FIG. 2, the first insulated electrical wire 110 includes a first conductive core 112 and a first insulating layer 114. The first insulating layer 114 covers the first conductive core 112, and the first conductive core 112 is partially exposed to form a first soldering section 116.

The number of first soldering sections 116 on the first insulated electrical wire 110 is determined according to the number of the sets of the LED devices (and of LED assemblies 151). In an embodiment, and as depicted in FIG. 1B, each LED assembly 151 includes a set of LED devices 130 that has two LED devices 130. In other embodiments, a set may include three or more LED devices 130. In an embodiment including three LED devices 130, three colors of light may be emitted by the set of LED devices 130, one color for each LED device 130. In an embodiment each of the three colors are different from one another, as opposed to any two LED device emitting substantially the same color.

In an embodiment an LED device 130 comprises a single LED, emitting a single color.

In another embodiment, an LED device 130 includes multiple LEDs, such as a red-green-blue (RGB) LED, and a controller chip, such that the LED device 130 is capable of emitting a light color determined by control data, such as that stored in the controller chip or otherwise communicated to the controller chip, as would be understood by one of ordinary skill in the art.

The second insulated electrical wire 120 includes a second conductive core 122 and a second insulating layer 124. The second insulating layer 124 covers the second conductive core 122, the second conductive core 122 is partially exposed to form a second soldering section 126, and the first conductive core 112 and the second conductive core 124 are electrically isolated from each other. In an embodiment, the first insulating layer 114 and the second insulating layer 124 are joined together by a portion of insulating material located between wires 110 and 120. In an embodiment, insulating layers 114 and 124 are formed, such as by extrusion, over conductive cores 112 and 114 during the manufacturing process, causing wires 110 and 120 to be mechanically joined together at the insulating layers 114 and 124. In an embodiment, wires 110 and 120 may be spaced apart and connected by a laterally-extending, as well as axially-extending, portion of insulation between the wires. Such a joining portion is described in further detail in U.S. pending application Ser. No. 16/298,935, entitled Dual-Color Light Emitting Diode Light Strings, which is incorporated herein by reference in its entirety.

The number of the second soldering sections 124 on the second insulated electrical wire 120 may be determined according to the number of LED assemblies 151 and the sets of the LED devices 130, with one first soldering section 116 being paired with one second soldering section 126.

In an embodiment, the first conductive core 112 and the second conductive core 122 comprise copper or copper alloy wires, with the metal or alloy having good ductility and conductivity. Cores 112 and 122 may also comprise primarily aluminum wires, rather than copper. Other conductive materials, including nickel, and other metals, may be used, as would be understood by one of ordinary skill.

In an embodiment, the first conductive core 110, as well as the second conductive core 120, may comprise a single conductor strand, as depicted in the figures. In other embodiments, the conductive cores may comprise multiple strands of conductors which in an embodiment, are twisted together.

In an embodiment, the first insulating layer 114 and the second insulating layer 124 are made of plastic. The first second insulating layer 114 and the second insulating layer 124 can be separated from each other or combined into one piece. In some embodiments, the first insulating layer 114 and the second insulating layer 124 are insulating coating, such as an enamel coated, for example, such that first insulated electrical wire 110 and the second insulated electrical wire 120 comprise enameled "magnet wires".

As shown in FIG. 1A and FIG. 2, the two LED devices 130 are respectively electrically connected to the first soldering section 116 and the second soldering section 126. In an embodiment, the direction of electrical bias of the two LED devices 130 from the first soldering section 116 to the second soldering section 126 are opposite to each other, as depicted in FIG. 1B.

In an embodiment, the two LED devices 130, LED device 130*a* and LED device 130*b*, are LED devices having different colors, for example, one LED device 130*a* comprising a blue LED device and the other LED device 130*b* comprising a red LED device; the red LED device being oppositely biased as compared to the blued LED device. In other words, when a bias voltage is applied to the first insulated electrical wire 110 and the second insulated electrical wire 120, only one of the two LED devices emits light while the other is disabled. In an embodiment, this opposite biasing arrangement is accomplished by electrically connecting the two LED devices 130 in parallel, with an anode from a first LED device 130*a* connected to the cathode of the other, or second, LED device 130*b*, with that anode and cathode being connected to one of wires 110 or 120. A cathode from the first LED device 130*a* is electrically connected to the anode of the second LED device 130*b*, and that anode and cathode are electrically connected to the other of the two wires 110 or 120. As such, the first and second LED devices 130 are connected in parallel to one another and oppositely electrically biased.

In an embodiment, and as depicted in FIG. 2, the transparent glue 140 covers the two LED devices 130, the first soldering section 116 and the soldering section 126 and extends to partially cover the first insulating layer 114 and the second insulating layer 124. In an embodiment, and as depicted, the transparent glue 140 has a largest cross-section located corresponding to the two LED devices 130, and the cross-section of the transparent glue 140 shrinks gradually along directions toward the first insulating layer 114 and the second insulating layer 124. That is, the transparent glue 140 not only covers the two LED devices 130, the first soldering section 116 and the soldering section 126, but also covers the parts of the first insulating layer 114 and the second insulating layer 124 adjacent the first soldering section 116 and the second soldering section 126.

In other embodiments, glue 140 does not cover portions of insulating layers 114 and 124; in one embodiment, glue 140 abuts insulating layers 114 and 124.

The material of the transparent glue 140 can be a rapid solidification glue such as a UV-cure adhesive. In an embodiment, liquid glue is dispensed onto the two LED devices 130 by a glue dispenser, the liquid glue flows to the first insulating layer 114 and the second insulating layer 124, and then the liquid glue is cured by directing UV light to the glue to solidify it.

The transparent glue 140 is used to protect the two LED devices 130, the first soldering section 116 and the second soldering section 126, and also serves as optical component for light diffusion.

Still referring to FIG. 1 and FIG. 2, in an embodiment, the dual-color light string 100 according to the first embodiment further includes a carrier 150. In the embodiment depicted, the two LED devices 130 are attached to single carrier 150. The two LED devices 130 may be combined into a single packaged chip, and disposed on one side of the carrier 150. Alternatively, the two LED devices 130 are provided as two separate LED chips, and respectively disposed adjacent one another on one side of the carrier 150. In these embodiments, light from LED devices 130 is transmitted axially, at least partially, in a direction generally parallel to a longitudinal or lengthwise axis of wires 110 and 120.

Alternatively, and not depicted, one LED chip is on one side of carrier 150 (front side), and the other is on another side of carrier 150 (back side), such that some light may be directed in opposite axial directions.

The electrode connection nodes 132 of the two LED devices 130 for connecting to the first soldering section 116 and the second soldering section 126 are located at two lateral edges, a first edge and a second edge, of the carrier 150. For firmly fixing the carrier 150, the carrier 150 is perpendicular to the first soldering section 116 and the second soldering section 126, such that a front side of the carrier, the one onto which the LED devices 130 are mounted, are directed toward the insulating layers 114 and 124 and parallel to lengthwise axes formed by each of the two wires 110 and 120. The carrier 150 includes two notches 152 at the two lateral edges, and the electrode connection nodes 132 of the two LED devices 130 for connecting the first soldering section 116 and the second soldering section 126 are respectively located in the notches 152. The first soldering section 116 and the second soldering section 126 are respectively inserted or embedded into the two notches 152, so as to initially fix the carrier 150 and connect the electrode connection nodes 132 to first soldering section 116 and second soldering section 126. In the first embodiment, two ends of the LED devices 130 share two electrode connection nodes 132. In one such embodiment, an anode of one LED device 130 and a cathode of the other LED device 130 share a common node 132.

In an embodiment, and as depicted notches 152 are defined by an arcuate surface of a node 132. In an embodiment, the notch 152 defines an arc radius that is approximately the same as the radius of a conductor core 112 or 122 so as to maximize contact between the node 132 and the soldering section of the conductor core. In an embodiment, node 132 defines a half circle (180° arc) and receives a portion of a soldering section 116 or 126 of conductor 112 or 122, respectively, that comprises approximately half of the circumference of the conductor core. In one such embodiment, lateral forces between wire 110 and 120, assist in holding the carrier 150 in position between the two wires.

In an alternate embodiment, notch 152 defines an arc that is slightly larger than 180°, such that notch 152 contacts more than half the circumference of the conductor. In such an embodiment, a soldering section 116 or 126 is forced into notch 152, creating an interference fit, or even a snap fit, thereby further assisting in holding carrier 150 in position between wires 110 and 120.

Figure 3:
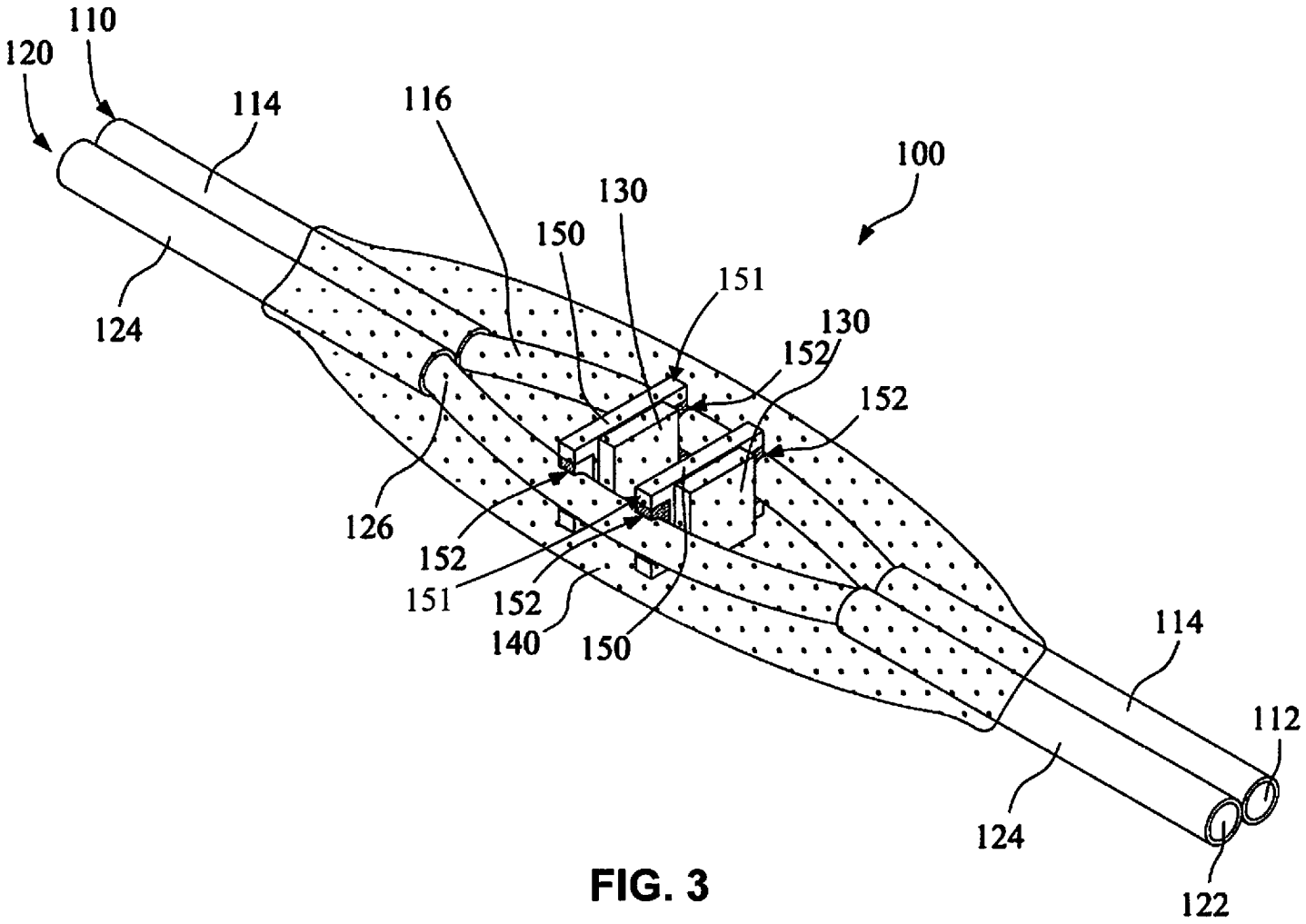
FIG. 3 is a three dimensional view of a first insulated electrical wire, a second insulated electrical wire and two LED devices combined together according to a second embodiment of the instant disclosure.
Figure 4:
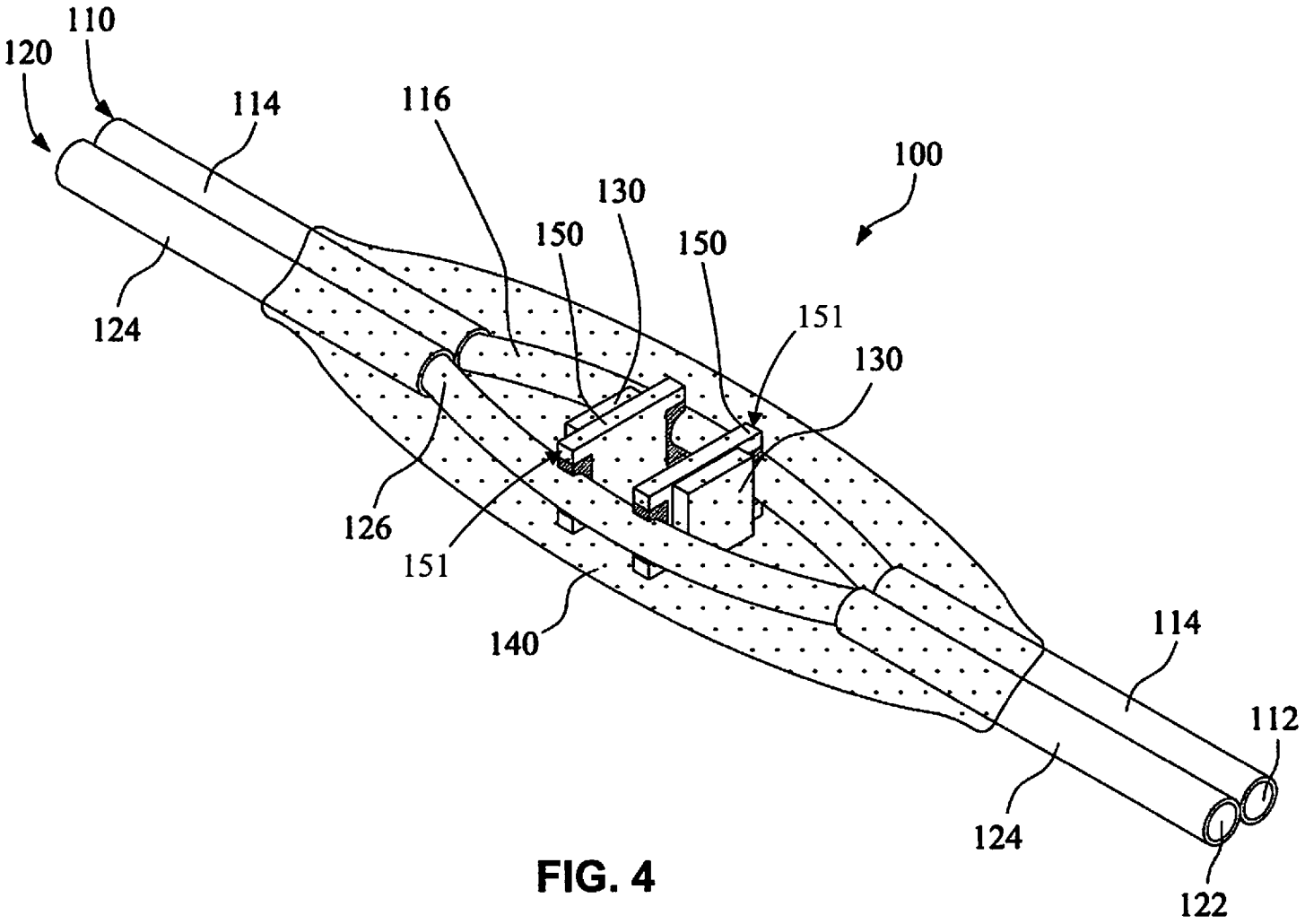
FIG. 4 is a three dimensional view of the first insulated electrical wire, the second insulated electrical wire and the two LED devices combined together according to the second embodiment of the instant disclosure.

As depicted in FIG. 3 and FIG. 4, a dual-color light string 100 according to a second embodiment comprises a first insulated electrical wire 110, a second insulated electrical wire 120, two LED assemblies 151, each with a carrier 150 and an LED device 130, and transparent glue 140.

The dual-color light string 100 according to the second embodiment includes two carriers 150, and the two LED devices 130 are mounted on the two carriers 150, one on each carrier. The two carriers 150 are positioned perpendicular to the first soldering section 116 and the second soldering section 126, and each of the two carriers 150 includes two notches 152 at the two lateral edges. The first soldering section 116 and the second soldering section 126 are respectively embedded into the two notches 152.

In this second embodiment, and as depicted in FIG. 4, the two LED devices 130 are on same side of the two carriers 150, such that both LED devices 130 face the same direction. In one such embodiment, the light from one LED is transmitted toward a back side of an adjacent carrier 150, thereby reflecting some light off of the adjacent carrier 150, while the other LED device 130 on the other carrier 150 transmits or directs light toward adjacent insulating layers 114 and 124, as well as portions of soldering sections 116 and 126.

In an alternate second embodiment, as depicted in FIG. 4, the two LED devices 130 face in opposite directions. In one such embodiment, light from one LED device 130 directs light toward adjacent insulating layers 114 and 124, as well as adjacent portions of soldering sections 116 and 126. Light from the other LED device 130 is directed in an opposite direction, toward adjacent insulating layers 114 and 124, as well as adjacent portions of soldering sections 116 and 126. In this alternate second embodiment, a different lighting effect is achieved as light is directed and reflected in a different manner as compared to those lighting effects achieved by the embodiments of FIGS. 1 and 2 or FIG. 3.

In an embodiment, the LED devices 130 of light string 100 of FIGS. 3 and 4 are electrically configured to form the circuit depicted in FIG. 1B, even though the LED devices 130 are disposed on separate carriers 150.

Figure 5:
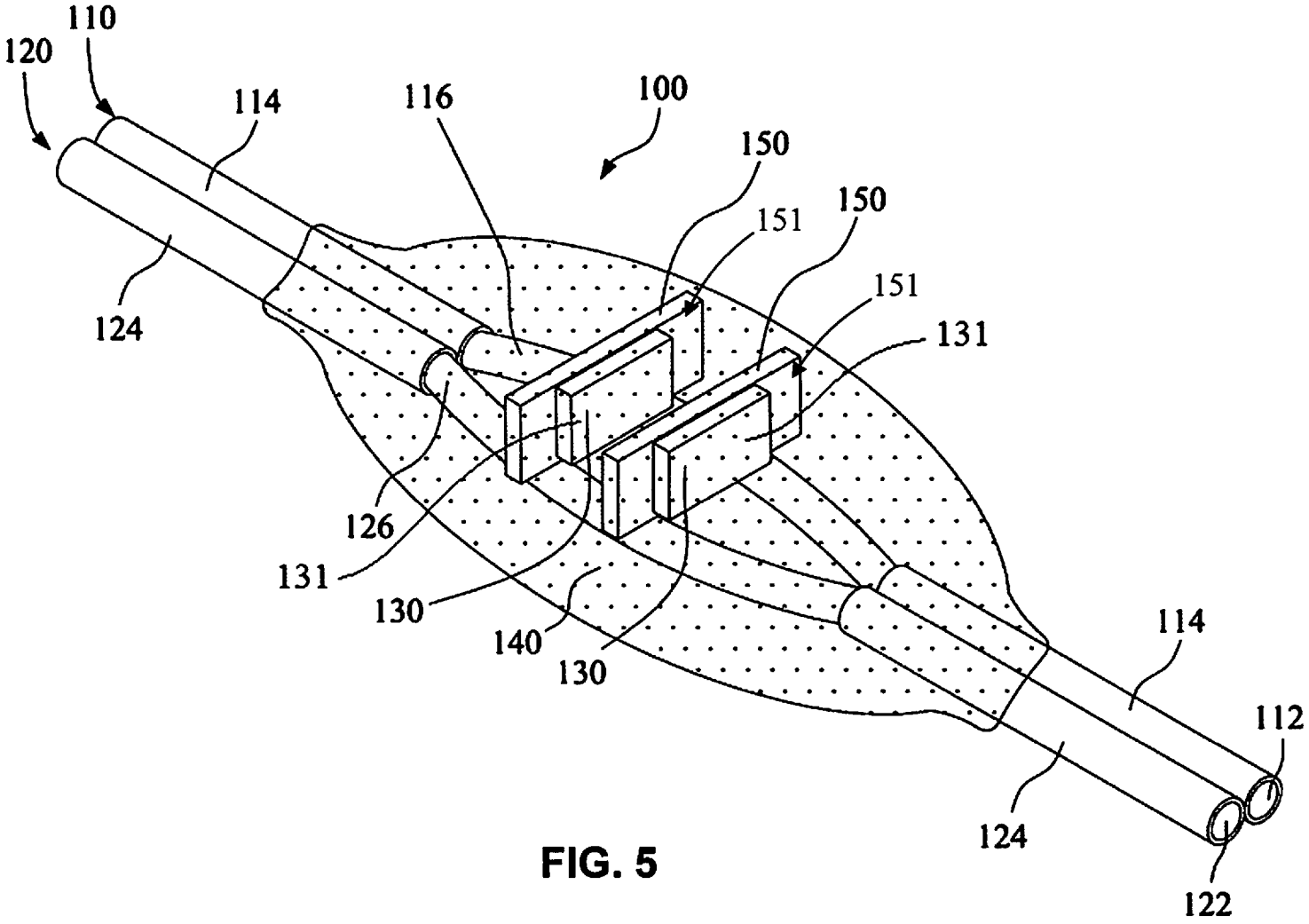
FIG. 5 is a three dimensional view of the a electric wire, a second insulated electrical wire and two LED devices combined together according to a third embodiment of the instant disclosure.
Figure 6:
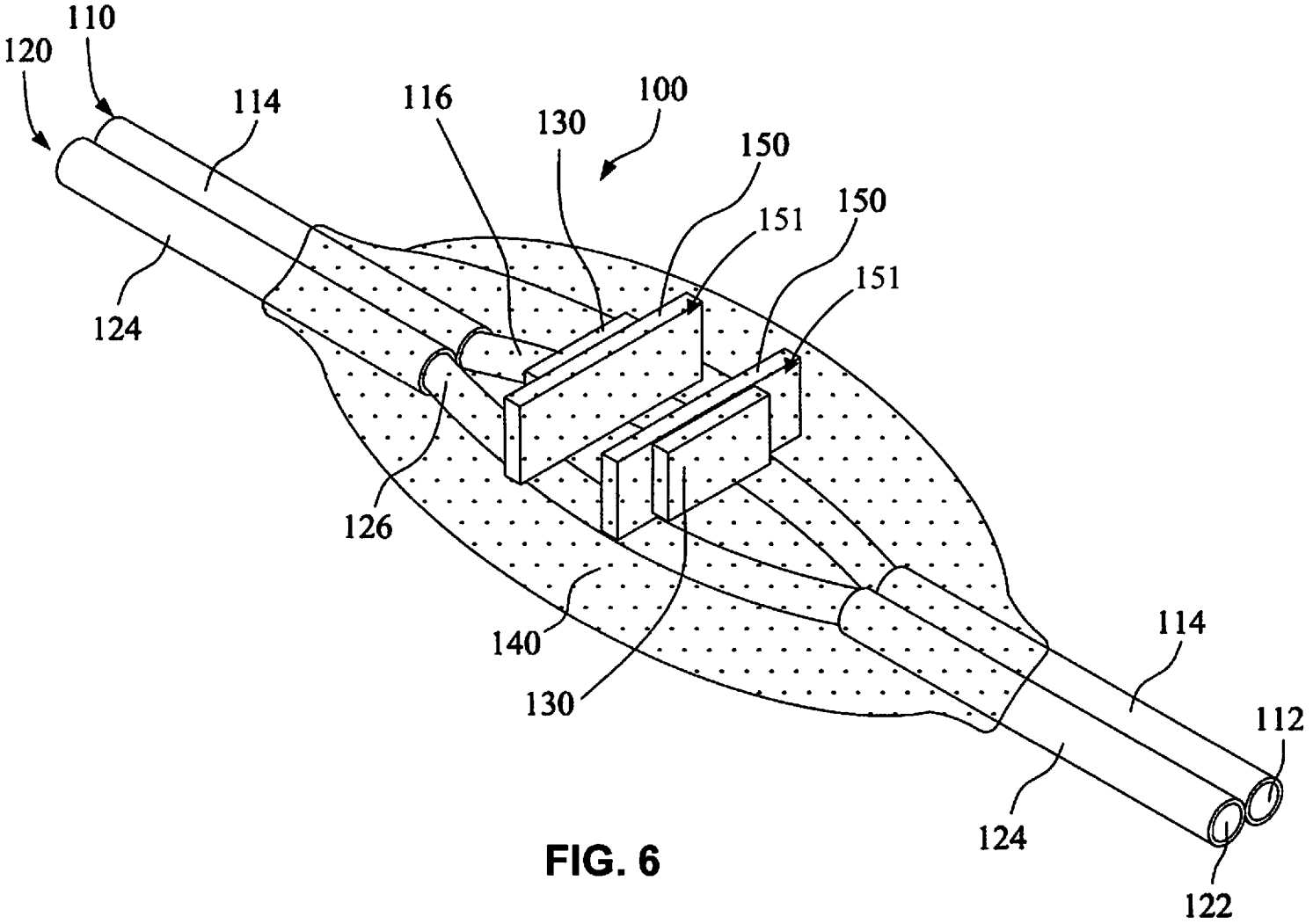
FIG. 6 is a three dimensional view of the first insulated electrical wire, the second insulated electrical wire and the two LED devices combined together according to the third embodiment of the instant disclosure.

Referring to FIG. 5 and FIG. 6, a dual-color light string 100 according to a third embodiment comprises a first insulated electrical wire 110, a second insulated electrical wire 120, two LED assemblies 151 each with an LED device 130 carrier 150, and transparent glue 140.

In the depicted embodiment, the soldering pads are disposed on the side of the carrier 150 and are soldered onto the first soldering section 116 and the second soldering section 126, while the LED top surfaces 131 are perpendicular to wires 110 and 120.

Alternatively, rather than disposing the carrier 150 on its side, such that a bottom surface of each carrier 150 is perpendicular to the first insulated electrical wire 110 and the second insulated electrical wire 120, the carrier 150 may alternatively be disposed on its bottom and in parallel to the first insulated electrical wire 110 and the electric wire 120, so as to increase the soldering area on the first soldering section 116 and the second soldering section 126. See also, FIG. 7 which depicts carriers 150 arranged such that the bottom surfaces of the carriers 150 and associated soldering pads are in contact with sections 116 and 126. However, unlike the LED devices of FIG. 7, in an embodiment, rather than emit light from a top surface 131, LED devices emit light from a side of the LED devices, so as to direct light parallel to wires 110 and 120.

In the embodiments of FIGS. 5 and 6, the directions of light emission are in parallel to the first insulated electrical wire 110 and the second insulated electrical wire 120, and the directions of light emitting of the two LED devices 130 are the same (FIG. 5) or opposite (FIG. 6) to each other.

Figure 7:
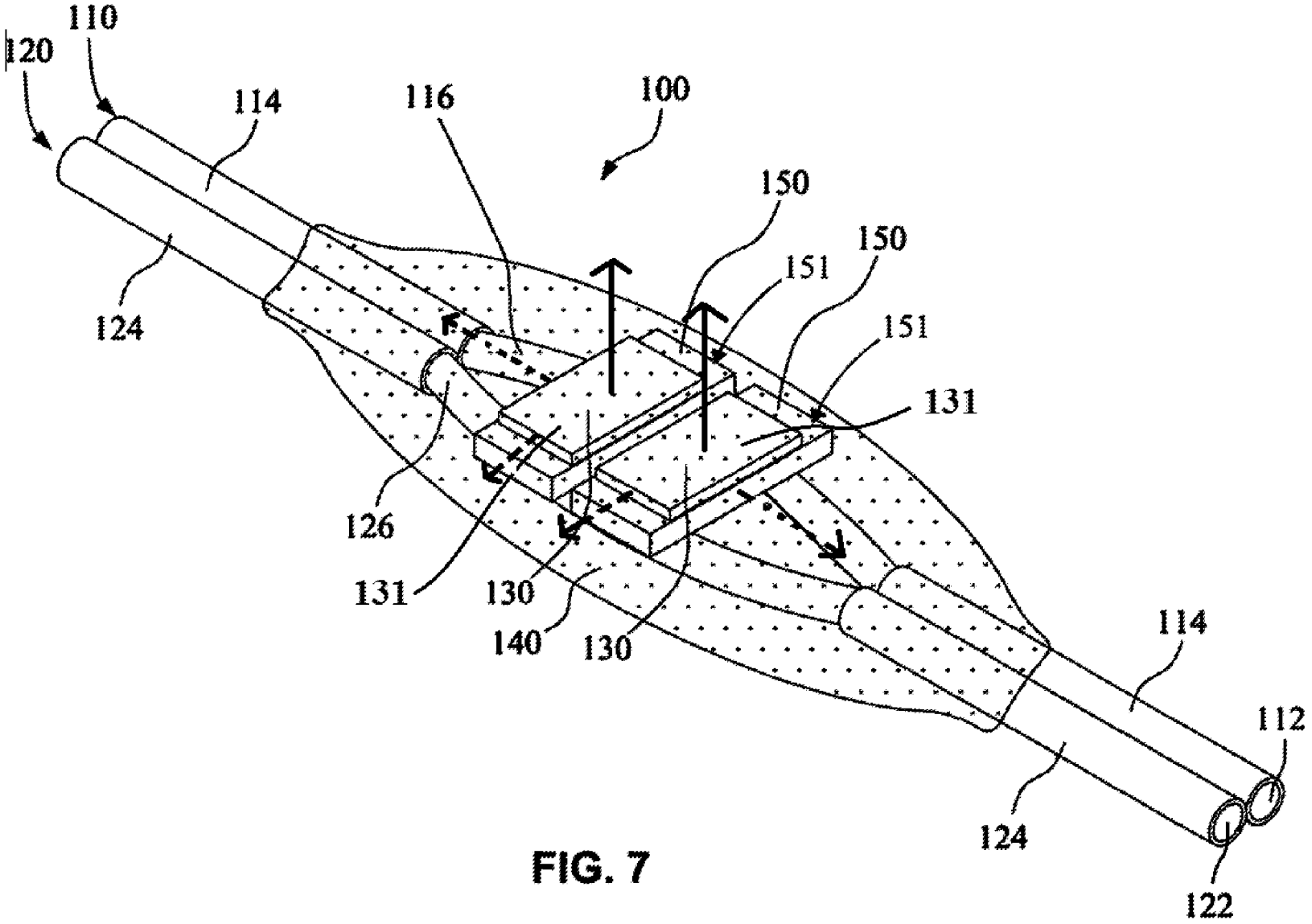
FIG. 7 is a three dimensional view of a first insulated electrical wire, a second insulated electrical wire and two LED devices combined together according to a fourth embodiment of the instant disclosure.

Referring to FIG. 7, a dual-color light string 100 according to a fourth embodiment comprises a first insulated electrical wire 110, a second insulated electrical wire 120, two LED assemblies 151 each with an LED device 130 and a carrier 150, and transparent glue 140.

In an embodiment, the carrier 150 in the fourth embodiment may not include the side notches 152; the two carriers 150 are disposed with soldering pads on the bottom surfaces on the first soldering section 116 and the second soldering section 126, such that LED devices 130 face in a direction transverse to the axes of wires 110 and 120, which may be considered an "upward" direction. The bottom side of the two carriers 150 are directly soldered to the first soldering section 116 and the second soldering section 126. The two LED devices 130 as depicted emit light upward (top/front-emit) from a top surface 131, as exemplified and indicated by the solid-line arrows, but alternatively, LED devices 130 may be side-emitting LED devices that emit light transverse to a top surface 131, as exemplified and indicated by the broken-line arrows. In other words, the carriers 150 in the third embodiment can be placed horizontally and the LED devices 130 are arranged to emit light laterally (including being parallel to wires 110 and 120).

Figure 8A:
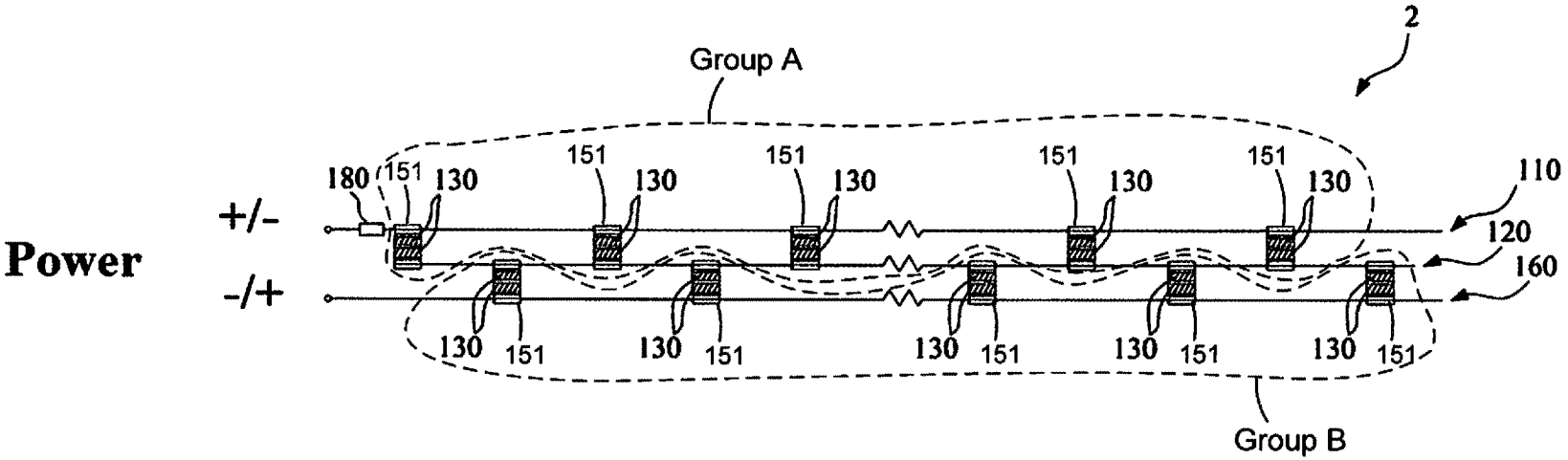
FIG. 8A is a circuit diagram of a circuit of a light string according to an embodiment of the instant disclosure.
Figure 8B:
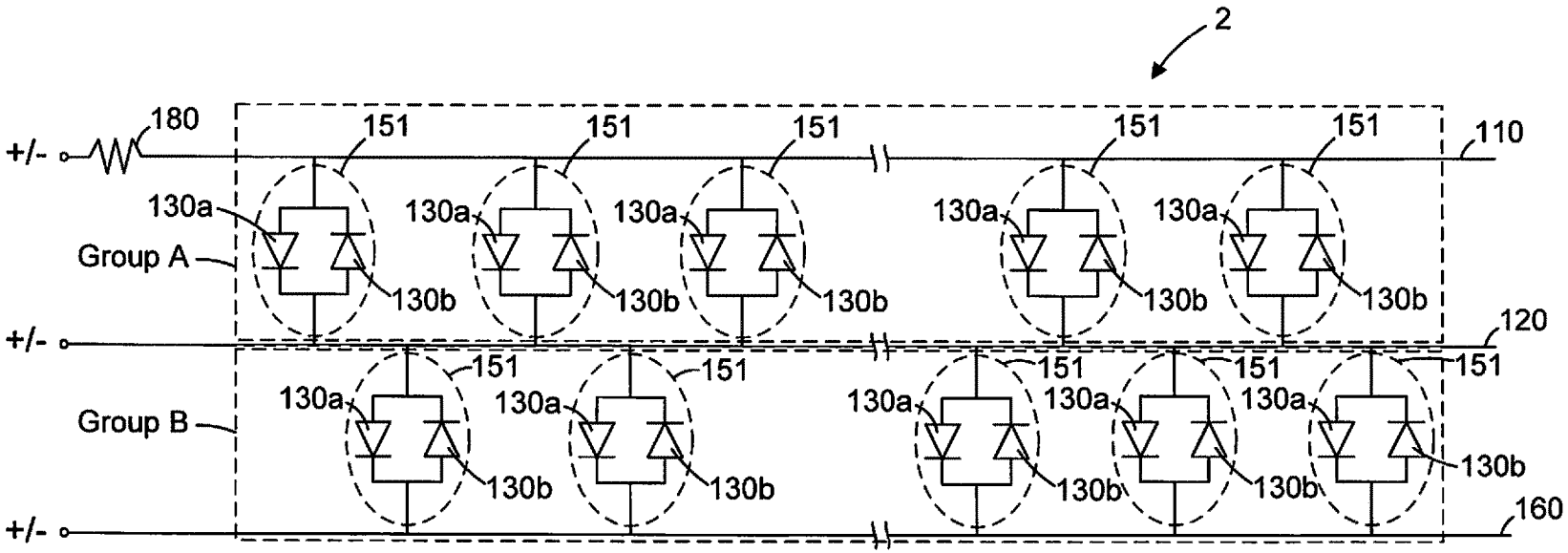
FIG. 8B is a circuit diagram of the circuit of FIG. 8A, further depicting individual LED devices.

Referring to FIGS. 8A and 8B, a circuit 2 for the dual-color light string is shown according to an embodiment, for arranging the dual-color light string 100 as shown in the first to fourth embodiments into a long light string with serial and parallel circuit loops.

As shown in FIG. 8, the circuit 2 comprises a first insulated electrical wire 110, a second insulated electrical wire 120, a third insulated electrical wire 160 and a plurality of pairs of LED devices 130.

As shown in FIG. 8, circuit 2 of the light string is configured to receive power at wires 110 and 160. In an embodiment, the first insulated electrical wire 110 is configured to receive a first voltage, and the third electric wire 160 configured to a second voltage. In an embodiment, circuit 2 may be configured to receive direct current (DC) power.

In one such DC embodiment, the first voltage may be greater than the second voltage such that a positive voltage potential is applied from wire 110 to wire 160. In FIG. 8, this is depicted as wire 110 having a "+" or positive voltage, while wire 160 is depicted as having a "−" or negative voltage. In such an embodiment, the second voltage may be ground, or may simply be a voltage that is less than the first voltage so as to cause a positive voltage potential from wire 110 to wire 160. As described further below, a positive voltage potential from wire 110 to wire 160 will present a positive or forward electrical bias across first LED device 130*a* and cause a first LED device 130*a* to emit light of a first color.

In another DC embodiment, the second voltage may be greater than the first voltage such that a positive voltage potential is applied from wire 160 to wire 110 (or a "negative" voltage potential is applied from wire 110 to wire 160). In FIG. 8, this is depicted as wire 110 having a "−" or negative voltage, while wire 110 is depicted as having a "+" or positive voltage. In such an embodiment, the first voltage may be ground, or may simply be a voltage that is less than the second voltage so as to cause a positive voltage potential from wire 160 to wire 110. As described further below, a positive voltage potential from wire 1600 to wire 110 will present a forward bias across second LED device 130*b* and cause second LED device 130*b* to emit light of a second color.

The second insulated electrical wire 120 is used as a connection node between the sets of LED devices 130. In practice, any two of the first insulated electrical wire 110, the second insulated electrical wire 120 and the third electric wire 160 in the this circuit embodiment are used to be the first insulated electrical wire 110 and the second insulated electrical wire 120 in the first to fourth embodiments.

As depicted in FIGS. 8A and 8B, the LED assemblies 151 and the plurality of pairs of LED devices 130 are categorized into two groups. In the first group "A", each one of the pair of the LED devices 130*a* is connected in parallel to the other, each pair of LED devices 130 is connected in parallel to the others, and the first insulated electrical wire 110 and the second insulated electrical wire 120 serve as the two connecting nodes of the parallel LED devices 130 (similar to those embodiments described above). In the second group "B", each LED assembly 151 with each pair of LED devices 130*b* is connected in parallel to the other, each pair of LED devices 130*b* is connected in parallel to the others, and the second insulated electrical wire 120 and the third electric wire 160 serve as the two connecting nodes of the parallel LED devices 130. Furthermore, the second insulated electrical wire 120 is the connecting node between the first group A of LED devices 130 and the second group B of the LED devices 130, such that the first group A is serially connected to the second group B.

Still referring to FIGS. 8A and 8B, in an embodiment, and as depicted, the circuit 2 in a fifth embodiment further comprises an optional current-limiting resistor 180, electrically connecting the first insulated electrical wire 110 to an external source of power; the resistor 180 for limiting current in the first insulated electrical wire 110. The current-limiting resistor 180 limits the current in the first insulated electrical wire 110, so as to prevent the LED devices 130 from being damaged by over-current.

In the embodiment depicted, the first insulated electrical wire 110, the second insulated electrical wire 120 and the third electric wire 160 are arranged in parallel, such that the insulating layers of the first insulated electrical wire 110, the second insulated electrical wire 120 and the third electric wire 160 can be combined together into a single piece. Consequently, only portions of the wires at the soldering sections need to be separated during manufacture of the light string 100 so as to attach the LED devices 130. By such an approach, the circuit 2 becomes a long single piece light string for convenient wiring arrangement.

Figure 9A:
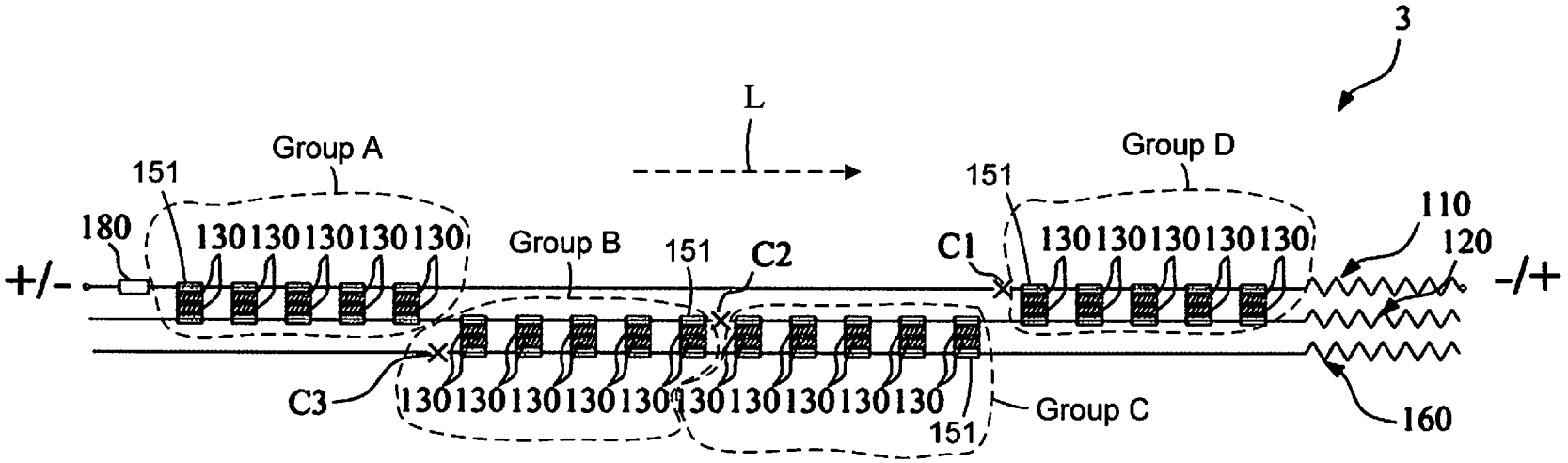
FIG. 9A is an embodiment of another circuit diagram of a circuit of light string according to an embodiment of the instant disclosure.
Figure 9B:
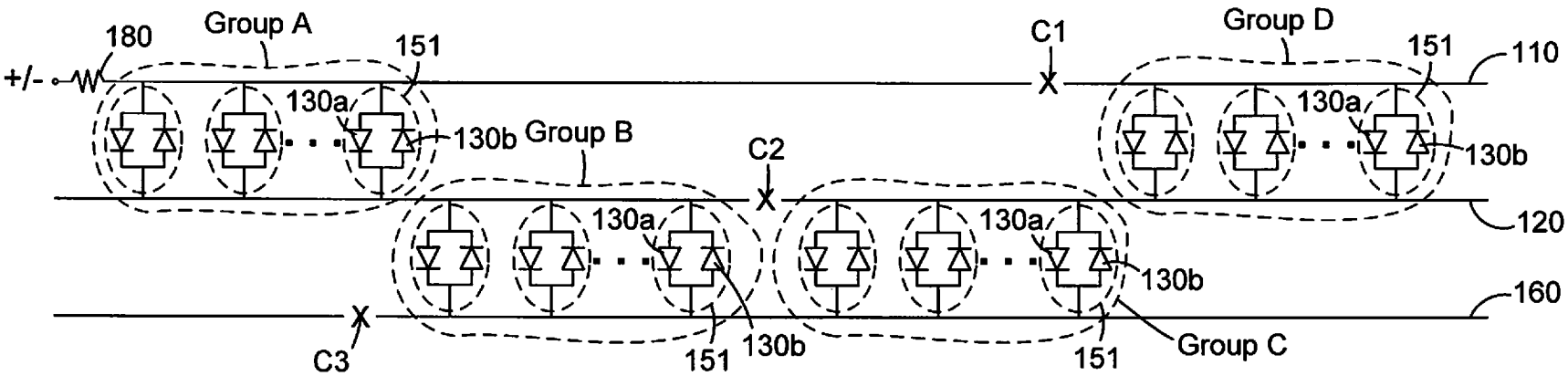
FIG. 9B is a circuit diagram of the circuit of FIG. 9A, further depicting individual LED devices.

Referring to FIGS. 9A and 9B, another embodiment of a circuit 3 of the light string comprises a first insulated electrical wire 110, a second insulated electrical wire 120, a third electric wire 160 and a plurality of LED assemblies 151, each assembly 151 having a pair of LED devices 130 (130*a* and 130*b*). The circuit 3 further comprises a third cut-off point C3 indicated with an "X" in the figures, a second cut-off point C2 indicated with another "X" and a first cut-off point C1 indicated with another "X", to form the circuit loop in the this embodiment. A cut-off point refers to a point in the wire where the conductor is "broken," such that the wire is discontinuous at the cut-off point. A cut-off point may be accomplished during manufacture by punching out, or otherwise removing, a small section of insulated wire or conductor. A cut-off point may also be accomplished by cutting or breaking the wire without removing a portion of the wire.

Any two of the first insulated electrical wire 110, the second insulated electrical wire 120 and the third electric wire 160 in this circuit embodiment can be used to be the first insulated electrical wire 110 and the second insulated electrical wire 120 in the first to fourth embodiments of light strings 100 described above.

Referring to FIGS. 9A and 9B, the first insulated electrical wire 110, the second insulated electrical wire 120 and the third electric wire 160 are arranged in parallel along an axially-extending direction L. In an embodiment, the three electrical wires are single metal wires or stranded conductors combined together by a one piece insulating layer. The third cut-off point C3, the second cut-off point C2 and the first cut-off point C1 are arranged sequentially along the extending direction L and respectively "cutting off" the third electric wire 160, the second insulated electrical wire 120 and the first insulated electrical wire 110, so as to divide the circuit 3 into plural sections according to the third cut-off point C3, the second cut-off point C2 and the first cut-off point C1. As described above, the term "cutting off" means cutting or breaking or otherwise interrupting the conductor core so as to cause an electrical discontinuity in the conductor core and wire.

The plurality of pairs of LED devices 130 (each "pair" having two LED devices 130 electrically connected to each other in parallel) are categorized into groups, each group having a plurality of pairs of LED devices 130, each of the plurality of pairs of LED devices 130 electrically connected to one another in parallel. The first group "A" of the LED devices 130 is arranged before the first cut-off point C1 along the extending direction L, and connected to the first insulated electrical wire 110 and the second insulated electrical wire 120.

The second group of the LED devices 130, Group B, are arranged between the third cut-off point C3 and the second cut-off point C2 along the extending direction L, and connecting to the second insulated electrical wire 120 and the third electric wire 160.

The third group of the LED devices 130, Group C, are arranged after the second cut-off point C2 along the extending direction L, and connecting to the second insulated electrical wire 120 and the third electric wire 160.

Referring to FIG. 9, The fourth group or the rest of the LED devices 130, Group D, are arranged after the first cut-off point C1 and the second cut-off point C2 along the extending direction Land connected to the first insulated electrical wire 110 and the second insulated electrical wire 120.

By such an approach, the LED devices 130 are sorted into four groups, Groups A, B, C and D. Each of the first group, Group A, of the LED devices 130 is connected in parallel, and the first insulated electrical wire 110 and the second insulated electrical wire 120 serve as the two connecting nodes of the parallel LED devices 130. The second LED devices 130, Group B, are connected in parallel, and the second insulated electrical wire 120 and the third electric wire 160 serve as the two connecting nodes of the parallel LED devices 130. Meanwhile, the second insulated electrical wire 120 is the connecting node between Group A of LED devices 130 and Group B of the LED devices 130, such that the Group A is serially connected to Group B.

The third LED devices 130, Group C, are connected in parallel, and the second insulated electrical wire 120 and the third electric wire 160 serve as the two connecting nodes of the parallel LED devices 130. The second insulated electrical wire 120 between the second group and the third group is cut off by the second cut-off point C2, such that the third group of LED devices 130, Group C, is serially connected to the second group of LED devices 130, Group B. Similarly, the fourth group of the LED devices 130, Group D, is connected in parallel, and the first insulated electrical wire 110 and the second insulated electrical wire 120 serve as the two connecting nodes of the parallel LED devices 130, and the first insulated electrical wire 120 between the first group and the fourth group is cut off by the first cut-off point C1, such that the fourth group of LED devices 130, Group D, is serially connected to the third group of LED devices 130, Group C.

In an embodiment, the first electric wire 110 is used to transmit power from a power source, such as from controller 101 to the LED devices 130. As described above, power may be selectively transmitted such that on LED device 130 of a set of LED devices 130 of an LED assembly 151, such as an LED device 130*a*, is powered, while the other LED device 130, such as LED device 130*b*, is not powered, due to opposite biasing of the LED devices 130 of the set. In an embodiment, a DC voltage is selectively transmitted so as to switch polarity or biasing; in an alternative embodiment, AC power may be applied, as discussed above with respect to the other embodiments. In the embodiments of FIGS. 9A and 9B, power is applied at one end of wire 110 adjacent Group A, and at another end of wire 110 adjacent Group D, as depicted.

In an embodiment, the first insulated electrical wire 110, the second insulated electrical wire 120 and the third electric wire 160 are arranged in parallel, the circuit 3 becomes a long single piece light string for convenience of cords arrangement.

In an embodiment, the circuit 3 may include a current-limiting resistor 180, electrically connecting the first insulated electrical wire 110 to the source of power for limiting current in the first insulated electrical wire 110. The current-limiting resistor 180 limits the e current the first insulated electrical wire 110, so as to prevent the LED devices 130 from being damaged by over-current.

Figure 10:
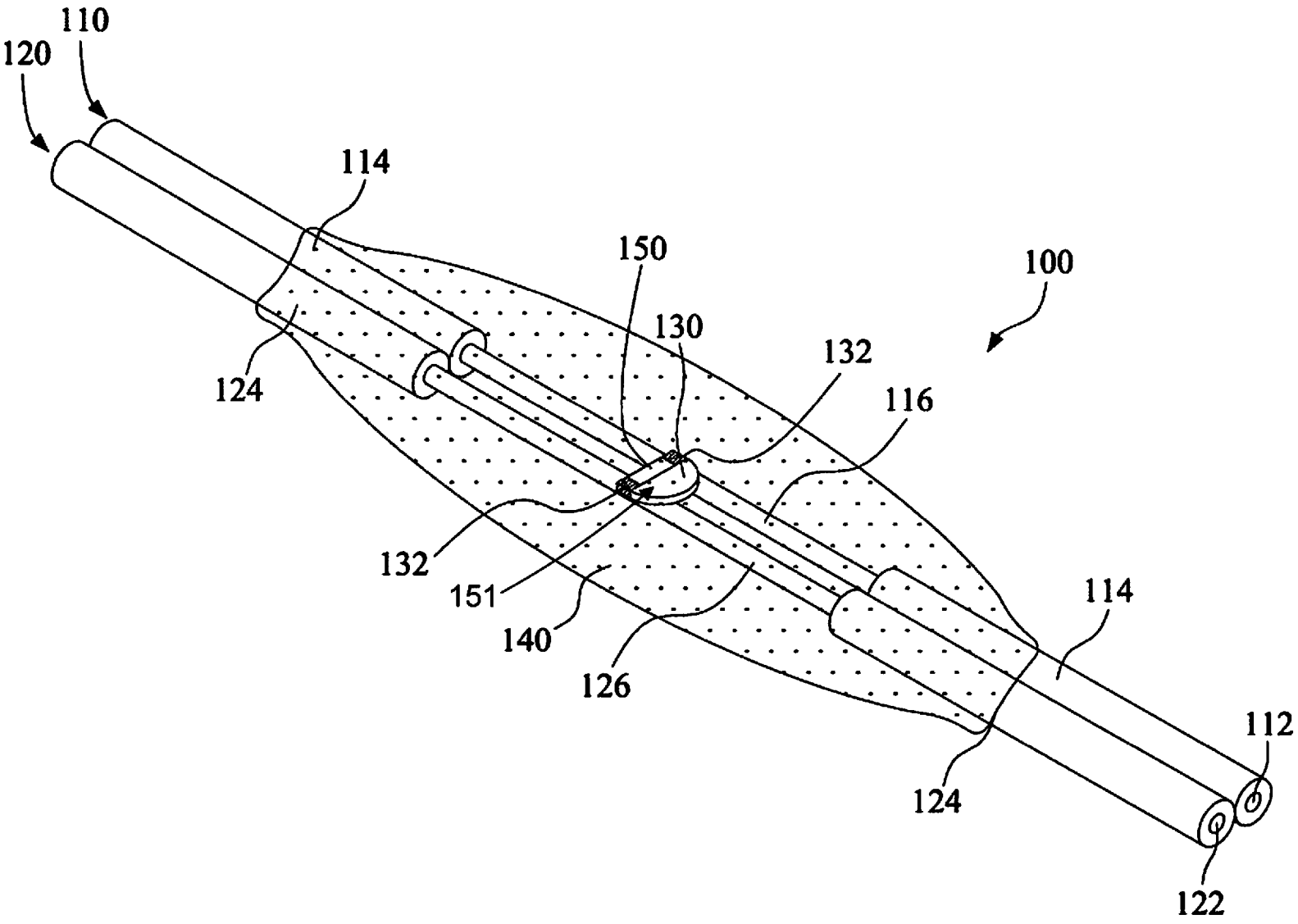
FIG. 10 is a three dimensional view of a first insulated electrical wire, a second insulated electrical wire and a LED device combined together according to a seventh embodiment of the instant disclosure.

Referring to FIG. 10, a light string 100 according to a seventh embodiment comprises a first insulated electrical wire 110, a second insulated electrical wire 120, an LED device 130, a carrier 150 and a transparent glue 140.

Referring to FIG. 10, the first insulated electrical wire 110 includes a first conductive core 112 and a first insulating layer 114. The first insulating layer 114 covers the first conductive core 112 and the first conductive core 112 is partially exposed to form a first soldering section 116. The second insulated electrical wire 120 includes a second conductive core 122 and a second insulating layer 124. The second insulating layer 124 covers the second conductive core 122, the second conductive core 122 is partially exposed to form a second soldering section 126, and the first conductive core 112 and the second conductive core 122 are electrically isolated from each other.

Referring to FIG. 10, the carrier 150 is fixed on the first conductive core 112 and the second conductive core 122, and the LED device 130 is disposed on a lateral side of the carrier 150. The electrode connection nodes 132 of the LED device 130 for connecting the first soldering section 116 and the second soldering section 126 are located at two lateral edges of the carrier 150. By soldering the electrode connection nodes 132 onto the first soldering section 116 and the second soldering section 126, the carrier 150 is fixed on the first soldering section 116 and the second soldering section 126.

The LED device 130 is electrically connected to the first soldering section 116 and the second soldering section 126 via the electrode connection nodes 132. The LED device is a side-emitting LED device having a light emitting direction in parallel to the first insulated electrical wire 110 and the second insulated electrical wire 120. The transparent glue 140 covers the LED device 130, the first soldering section 116 and the second soldering section 126 and extending to partially cover the first insulating layer 114 and the second insulating layer 124. In one embodiment, at least two LED devices 130 are respectively soldered onto plural pairs of soldering sections 124 and 126, and the direction of bias of the these LED devices 130 from the first soldering section 116 to the second soldering section 126 are opposite to each other, so as to form a dual-color light string.

In the dual-color light string according to one or more embodiments of the instant disclosure, the LED devices 130 are firmly fixed between the first insulated electrical wire 110 and the second insulated electrical wire 120 to provide dual-color illumination. \

In an embodiment, one or more light strings 100 may be applied to a multi-section artificial tree, such that embodiments of the disclosure include artificial trees with light strings 100. In one such embodiment, the number of light strings, and the number of lights may depend on the height and girth of the tree, with taller and/or larger trees having more light strings and more lights.

In an embodiment, one light string 100 is connected to a single branch of the tree. In another embodiment, one light string 100 is connected to multiple branches of the tree. In an embodiment wherein the artificial tree has multiple tree sections or portions, such as a lower, upper and middle tree portion, such as a tree described in U.S. Pat. No. 8,454,186, Modular Lighted Tree (incorporated herein by reference in its entirety), each tree section may include a single light string 100, rather than multiple light strings 100. In an alternate embodiment, each tree section includes multiple light strings 100, but only one light string 100 is used for all branches at a common height along the trunk of the tree.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A dual-color light-emitting diode (LED) light string, comprising:

a first insulated electrical wire including a first conductive core and a first insulating layer; wherein the first insulating layer covers the first conductive core and the first conductive core is partially exposed to form a first soldering section, the first insulated electrical wiring defining a first wire portion and a second wire portion, the first soldering section being located between the first wire portion and the second wire portion;

a second insulated electrical wire including a second conductive core and a second insulating layer; wherein the second insulating layer covers the second conductive core, the second conductive core is partially exposed at a first portion of the second insulated electrical wire to form a second soldering section and is partially exposed at a second portion of the second insulated electrical wire to form a third soldering section;

a third insulated electrical wire including a third conductive core and a third insulating layer; wherein the third insulating layer covers the third conductive core, the third conductive core is partially exposed to form a fourth soldering section a first pair of LEDs respectively electrically connected to the first soldering section and the second soldering section and having a first LED and second LED, and the direction of electrical bias of the first LED and the second from the first soldering section to the second soldering section are opposite to each other, the first LED of the first pair of LEDs configured to emit light of a first color, and the second LED of the first pair of LEDs configured to emit light of a second color, the second color being different than the first color; and a first transparent glue portion covering the first pair of LEDs, the first soldering section and the second soldering section and extending to partially cover the first insulating layer and the second insulating layer;

a second pair of LEDs respectively electrically connected to the third soldering section and the fourth soldering section and having a first LED and a second LED, and the direction of bias of the first LED of the second pair of LEDs and the second LED of the second pair of LEDs from the third soldering section to the fourth soldering section are opposite to each other, the first LED of the second pair of LEDs configured to emit light of the first color, and the second LED of the second pair of LEDs configured to emit light of the second color; and a second transparent glue portion covering the second pair of LEDs, the third soldering section and the fourth soldering section and extending to partially cover the second insulating layer and the third insulating layer;

wherein the second wire portion of the first insulated electrical wire extends in parallel to the second insulated electrical wire, and terminates at a cut-off point such that the second wire portion of the first insulated electrical wire at the cut-off point is not mechanically connected to another portion of the second insulated electrical wire, and the first pair of LEDs is in electrical series with the second pair of LEDs.

2. The dual-color light string as claimed in claim 1, further comprising a first carrier wherein the first and second LEDs of the first pair of LEDs are on the first carrier.

3. The dual-color light string as claimed in claim 2, wherein the carrier is parallel to the first soldering section and the second soldering section, such that a largest surface of the carrier lies in a plane parallel to a plane that includes the first, second and third insulated electrical wires.

4. The dual-color light string of claim 2, wherein the carrier includes two notches at two lateral edges of the carrier and, the first soldering section and the second soldering section are respectively located at least partially in the two notches.

5. The dual-color light string as claimed in claim 1, wherein the first and second LEDs of the first pair of LEDs mounted respectively on two carriers.

6. The dual-color light string as claimed in Claim 5, wherein the two carriers are parallel to the first soldering section and the second soldering section.

7. The dual-color light string as claimed in Claim 5, wherein the two LED devices respectively emit light in a direction in parallel to the first insulated electrical wire and the second insulated electrical wire.

8. The dual-color light string as claimed in Claim 7, wherein the directions of light emitting of the two LED devices are same or opposite to each other.

9. The dual-color light string as claimed in claim 6, wherein the two carriers are pendicular to the first soldering section and the second soldering section such that a largest surface of the carrier lies in a plane perpendicular to a plane that includes the first, second and third insulated electrical wires.

10. An artificial tree comprising the light string of claim 1.

11. The artificial tree of claim 10, wherein the artificial tree includes multiple tree sections, including a lower section, a middle section, and an upper section, each section including multiple light strings, each light string distributed only on branches of the tree section at a common height.

12. The light string of claim 7, where the two LEDs are side-emitting LEDs.

13. The light string of claim 1, wherein each of the first LED and the second LED of the first pair of LEDs and the first LED and the second LED of the second pair of LEDs emit light from sides of their respective LEDs.

14. The light string of claim 1, further comprising a third pair of LEDs connected electrically in parallel to the first pair of LEDs to form a first group of LEDs, and comprising a fourth pair of LEDs connected electrically in parallel to the second pair of LEDs to form a second group of LEDs, the first group of LEDs electrically connected to the second group of LEDs in series.

15. The light string of claim 14, wherein the third insulated electrical wire defines a first wire portion and a second wire portion, one of the first or the second wire portions of the third insulated electrical wire extending in parallel with the second insulated electrical wire and terminating at a second cut-off point such that the one of the first or the second wire portions is not mechanically connected to another portion of the third insulated electrical wire.

16. The light string of claim 1, wherein the third insulated electrical wire defines a first wire portion and a second wire portion, one of the first or the second wire portions of the third insulated electrical wire extending in parallel with the second insulated electrical wire and terminating at a second cut-off point such that the one of the first or the second wire portions is not mechanically connected to another portion of the third insulated electrical wire.

17. A light-emitting diode (LED) light string, comprising:

a first insulated electrical wire including a first conductive core and a first insulating layer at least partially covering the first conductive core, the first conductive core being continuous from a first end of the first insulated electrical wire to a second end of the first insulated electrical wire, and the first conductive core is partially exposed at multiple locations along a length of the first insulated electrical wire to form a first plurality of soldering sections, the first insulating layer not covering the first conductive core at each of the first plurality of soldering sections;

a second insulated electrical wire including a second conductive core and a second insulating layer at least partially covering the second conductive core, the second conductive core being continuous from a first end of the second insulated electrical wire to a second end of the second insulated electrical wire, and the second conductive core is partially exposed at multiple locations along a length of the second insulated electrical wire to form a second plurality of soldering sections, the second insulating layer not covering the second conductive core at each of the second plurality of soldering sections;

a third insulated electrical wire including a third conductive core and a third insulating layer at least partially covering the third conductive core, the third conductive core being continuous from a first end of the third insulated electrical wire to a second end of the third insulated electrical wire, and the third conductive core is partially exposed at multiple locations along a length of the third insulated electrical wire to form a third plurality of soldering sections, the third insulating layer not covering the third conductive core at each of the third plurality of soldering sections;

a first plurality of LED pairs, each pair of the first plurality of LED pairs including a first LED and a second LED, each pair of the first plurality of LED pairs electrically connected to one of the first plurality of soldering sections and to one of the second plurality of soldering sections, wherein the first LED and the second LED of each pair of the first plurality of LED pairs is oppositely electrically biased, and the first LED and the second LED of each of the first plurality of LED pairs are connected to a common soldering section of the first plurality of soldering sections and a common soldering section of the second plurality of soldering sections;

a second plurality of LED pairs, each pair of the second plurality of LED pairs including a first LED and a second LED, each pair of the second plurality of LED pairs electrically connected to one of the second plurality of soldering sections and to one of the third plurality of soldering sections, wherein the first LED and the second LED of each pair of the second plurality of LED pairs is oppositely electrically biased, and the first LED and the second LED are connected to a common soldering section of the second plurality of soldering sections and a common soldering section of the third plurality of soldering sections;

wherein each pair of the first plurality of LED pairs is electrically connected to one another in parallel, and each pair of the second plurality of LED pairs is electrically connected to one another in parallel, and the first plurality of LED pairs is electrically connected to the second plurality of LED pairs in series; and wherein the pairs of LEDs of the first plurality of LED pairs and the second plurality of LED pairs alternate from the first ends of the first, second and third insulated electrical wires to the second ends of the first, second and third insulated wires in an alternating configuration such that each pair of LEDs of the first plurality of LED pairs is adjacent a pair of LEDs of the second plurality of LED pairs.

18. The LED light string of claim 17, wherein each of the first LEDs of each LED pair of the first plurality LED pairs is configured to emit light of a first color, and each of the second LEDs of each LED pair of the first plurality LED pairs is configured to emit light of a second color, the first color being different than the second color, and wherein each of the first LEDs of each LED pair of the second plurality LED pairs is configured to emit light of the first color, and each of the second LEDs of each LED pair of the second plurality LED pairs is configured to emit light of the second color.

19. The LED light string of claim 18, wherein the first insulated electrical wire and the third insulated electrical wire are connected to a power supply, and the second insulated electrical wire is not electrically connected to the power supply.

20. The LED light string of claim 19, further comprising a current-limiting resistor electrically connected to the first insulated electrical wire.

* * * * *